US007739925B2

(12) United States Patent
Foster

(10) Patent No.: US 7,739,925 B2
(45) Date of Patent: Jun. 22, 2010

(54) METHOD AND APPARATUS FOR CONTROLLING ADMISSION TO INDIVIDUAL RIDES AT AN AMUSEMENT PARK

(75) Inventor: Russell J. Foster, New York, NY (US)

(73) Assignee: GordonRides, LLC, White Plains, NY (US)

( * ) Notice: Subject to any disclaimer, the term of this patent is extended or adjusted under 35 U.S.C. 154(b) by 1416 days.

(21) Appl. No.: 11/076,346

(22) Filed: Mar. 9, 2005

(65) Prior Publication Data

US 2006/0205524 A1 Sep. 14, 2006

(51) Int. Cl.
*G01M 19/00* (2006.01)

(52) U.S. Cl. ..... 73/865.8

(58) Field of Classification Search ..... 73/865.8
See application file for complete search history.

(56) References Cited

U.S. PATENT DOCUMENTS

| | | | | |
|---|---|---|---|---|
| 2,836,980 | A * | 6/1958 | Giepen | 73/865 |
| 3,514,620 | A | 5/1970 | Wiggerman | |
| 4,923,024 | A | 5/1990 | Ferrer et al. | |
| 5,415,176 | A * | 5/1995 | Sato et al. | 600/547 |
| 5,566,327 | A | 10/1996 | Sehr | |
| 5,763,837 | A * | 6/1998 | Davignon et al. | 174/113 R |
| 5,914,463 | A | 6/1999 | Dlugos | |
| 5,979,941 | A * | 11/1999 | Mosher et al. | 283/67 |
| 6,173,209 | B1 | 1/2001 | Laval et al. | |
| 6,516,746 | B2 | 2/2003 | Pratt | |
| 6,523,741 | B1 | 2/2003 | DiMaria et al. | |
| 6,609,658 | B1 | 8/2003 | Sehr | |
| 6,611,787 | B2 | 8/2003 | Stringer et al. | |
| 6,617,960 | B1 | 9/2003 | Fischer et al. | |
| 6,629,019 | B2 | 9/2003 | Legge et al. | |
| 6,655,585 | B2 | 12/2003 | Shinn | |
| 6,657,543 | B1 | 12/2003 | Chung | |
| 6,690,673 | B1 | 2/2004 | Jarvis | |
| 2002/0082859 | A1 * | 6/2002 | Lancos et al. | 705/1 |
| 2003/0159300 | A1 * | 8/2003 | Moss et al. | 33/512 |

FOREIGN PATENT DOCUMENTS

| | | | |
|---|---|---|---|
| JP | 55057116 A | * | 4/1980 |
| JP | 08087623 A | * | 4/1996 |
| JP | 10027271 A | * | 1/1998 |

* cited by examiner

*Primary Examiner*—Hezron Williams
*Assistant Examiner*—Nashmiya S Fayyaz
(74) *Attorney, Agent, or Firm*—Gordon & Jacobson, PC

(57) ABSTRACT

Methods for controlling admission to amusement park rides include electronically measuring each child's height (and optionally weight) and comparing the measured data to a database which specifies minimum requirements for each ride in the amusement park. Upon completing the comparison, several optional steps are provided including encoding a data carrier with the child's measured data and/or a list of rides which are appropriate for the child. The data carrier may be a "swipe card" or other machine readable device which must be presented at the entrance to each ride. The entrance to each ride is provided with an electronic entry control gate which is operated by the data carrier. Optionally, a list of appropriate rides is printed for the child and/or the child's parents. Apparatus for performing the methods are also disclosed.

13 Claims, 4 Drawing Sheets

METHOD AND APPARATUS FOR CONTROLLING ADMISSION TO INDIVIDUAL RIDES AT AN AMUSEMENT PARK

BACKGROUND OF THE INVENTION

1. Field of the Invention

This invention relates broadly to methods and apparatus for controlling admission to rides at an amusement park. More particularly, this invention relates to methods and apparatus for controlling admission based on the height and/or weight (and optionally age) of a prospective rider.

2. State of the Art

Every year many children are injured (some killed) because they were riding on an amusement park ride which was inappropriate for their stature. While it is common practice to measure a child's height prior to admitting the child to a particular ride, the measurement is informal and depends on the judgment of a human attendant. The typical measurement apparatus is simply a mark on a wall against which a child stands and is observed by the ride operator. Often there will be many children crowding around and this will interfere with the ride operator's correct assessment of the child's height. The child may take the opportunity of crowded conditions to stand on his or her toes, unnoticed, so that s/he appears taller than s/he actually is.

SUMMARY OF THE INVENTION

It is therefore an object of the invention to provide methods and apparatus for controlling admission to individual rides at an amusement park.

It is another object of the invention to provide methods and apparatus which do not rely on human judgment for controlling admission to individual rides.

It is a further object of the invention to provide automated methods and apparatus for controlling admission to individual rides.

It is also an object of the invention to provide methods and apparatus for controlling admission to individual rides which determines at once which rides are appropriate and which are inappropriate for a particular child.

It is an additional object of the invention to provide methods and apparatus for controlling admission to individual rides whereby a child is prevented from riding inappropriate rides.

In accord with these objects, which will be discussed in detail below, the methods of the invention include measuring a child's height and/or weight, and optionally obtaining age information, and encoding a data carrier with information relating to the height and/or weight (and optionally age) of the child, and reading the data carrier at ride entry points to determine whether the child will be admitted to the ride. The data carrier may be a "swipe card" or other machine readable device which must be presented at the entrance to each ride. The entrance to each ride is provided with an electronic entry control gate which is operated by the data carrier. According to other aspects of the invention, after information about the child is obtained, the child's height and/or weight (and optionally age) is compared to a database and a printout listing rides to which the child will and/or will not be admitted is generated for the child and/or the child's parents.

The apparatus of the invention include an electronic measuring apparatus, a database, a plurality of data carriers, a data carrier encoder, a printer, and admission control equipment at each ride. The admission control equipment includes an electronic turnstile, a data carrier reader, and means for unlocking the turnstile based on the data read from the data carrier. The measuring apparatus includes sensors to determine whether the child is standing on his/her toes. According to one embodiment, the data carrier is a bar coded bracelet which cannot be removed from the child's wrist without destroying it. However, the data carrier can be a magnetic stripe card, a bar coded card, an RFID device, etc.

Additional objects and advantages of the invention will become apparent to those skilled in the art upon reference to the detailed description taken in conjunction with the provided figures.

DETAILED DESCRIPTION OF THE PREFERRED EMBODIMENTS

Figures 1, 2:
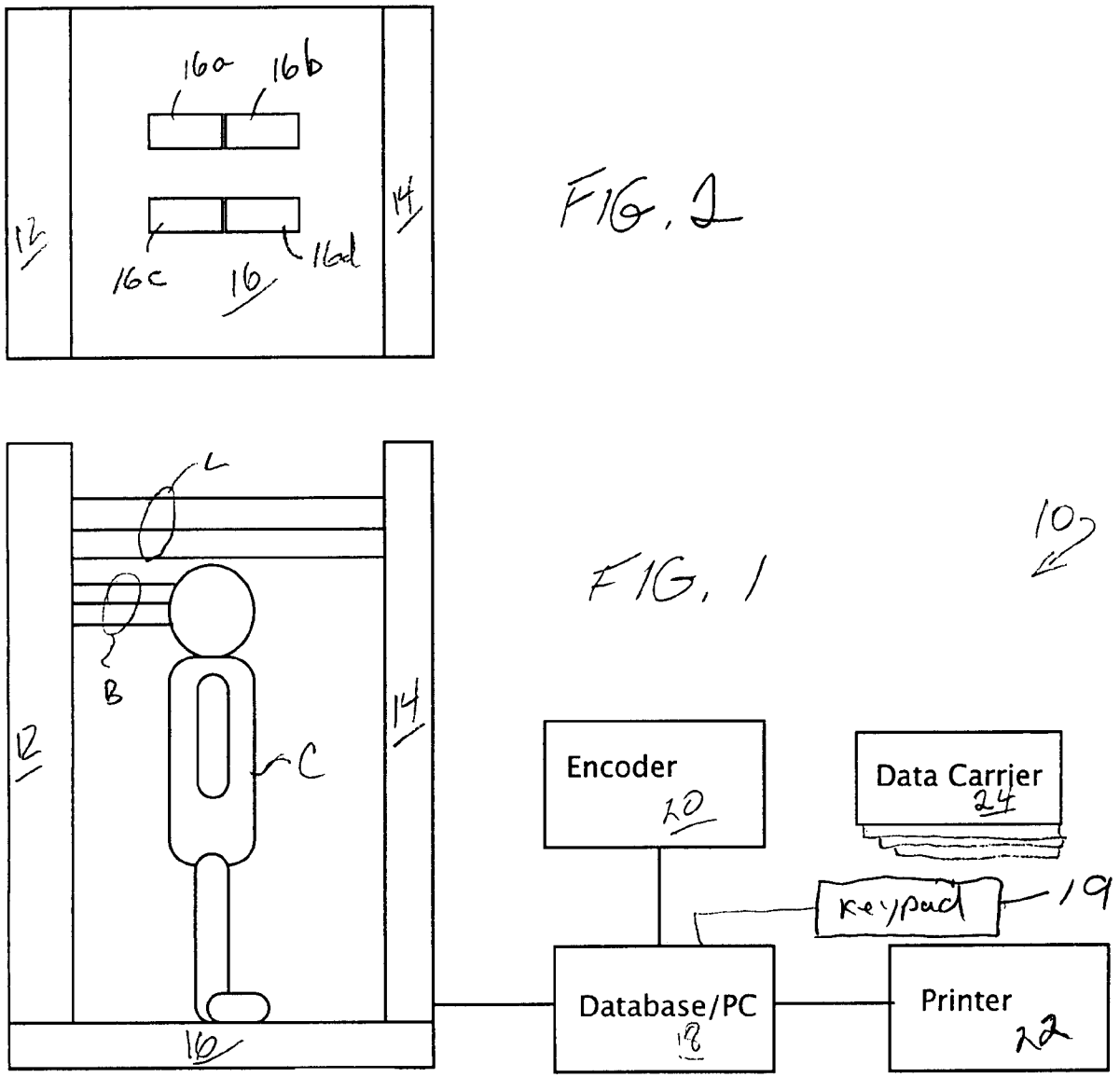
FIG. 1 is a schematic view of a measurement and data carrier encoding apparatus according to the invention.
FIG. 2 is a top plan view of the measurement apparatus.

Turning now to FIG. 1, an exemplary apparatus 10 according to the invention includes an LED emitter 12, a photo detector 14, a weighing platform 16, a processor with a database 18, a keypad 19, a data carrier encoder 20, a printer 22, and a plurality of data carriers 24. The LED emitter 12 includes a plurality of LEDs arranged in a vertical column spaced apart from each other, e.g. one inch apart. The photo detector 14 includes a plurality of photo detectors arranged in a vertical column corresponding to the LEDs. As shown in FIG. 1, a child C standing between the emitter 12 and detector 14 will block some beams of light B up to his or her height, above which beams of light L will pass and be detected by the detector 14. By determining which detectors detect light and which do not, the child's height can be determined.

As shown in FIG. 2, the weighing platform 16 includes four pressure sensors 16*a*-16*d*. In order to operate the device, the child must place the left foot heel on sensor 16*a*, the left foot toes on sensor 16*b*, the right foot heel on sensor 16*c*, and the right foot toes on sensor 16*d*. Only when all four sensors detect pressure will the child's height be measured. This prevents the child from standing on toes to appear taller.

The PC 18 is coupled to the photo detector array 14 and to the weighing platform 16 including the sensors 16*a*-16*d*. Preferably the PC 18 is also coupled to the LED array 12 so that it is only turned on when a child is standing on the weighing platform. The database in the PC 18 includes height and/or weight data (and optionally age data) for every ride in the amusement park. After the PC 18 is provided with the height, weight, and age (via the keypad 19) of the child, the attached encoder 20 is used to encode a data carrier 24 with information relating to the height, weight, and age of the child which will be used to control access to individual rides. Optionally, the PC 18 is coupled to a printer 22 which is used to print a list of rides from the database, the list consisting of the rides to which the child will be granted access and/or the rides to which the child will be denied access. The data encoded on the card can be an indication of the child's height and weight, e.g. inches and pounds, optionally the child's age, an indication of the rides the child will be admitted to, an indication of the rides the child will not be admitted to, a classification code, or some other data or datum which relates to the child's height, weight and age and can be used to determine admission to rides.

Figure 3:
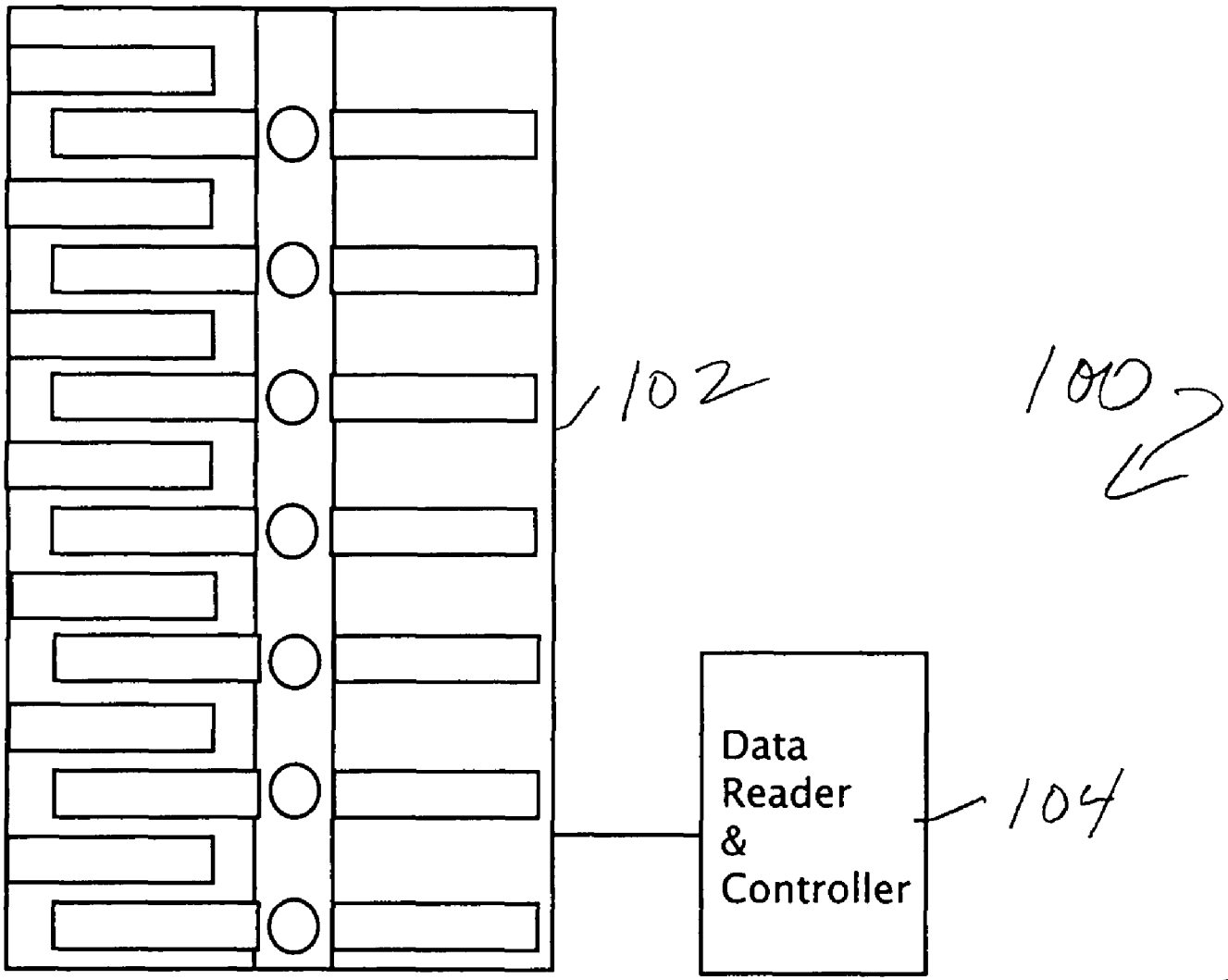
FIG. 3 is a schematic view of a data reader and electronic gate controller according to the invention.

FIG. 3 illustrates an admission control system 100 for an amusement park ride. The system 100 includes an electronically controlled turnstile 102 coupled to a data reader and controller 104. The data reader reads the data carrier (24 in FIG. 1) and determines from the data encoded therein whether to activate the turnstile and allow the child admission to the ride. It will be appreciated that the exact operation performed by the controller will depend on the data encoded on the carrier 24. If the data is an indication of the child's height/weight, the controller will perform a simple comparison of the child's height/weight to the height/weight requirement for this particular ride which will be stored in the controller. If the data includes an indication of the rides to which the child is permitted admission, the controller will read the list to determine whether this particular ride is contained in the list. A similar function with opposite result will be performed if the data includes an indication of the rides to which the child is denied admission. Still another possibility is to classify the child's height/weight into one of a plurality of groups and to classify the rides similarly. It will be appreciated that depending on the nature of the data used to determine ride access, the database 18 shown in FIG. 1 may not be needed to encode the data carrier 24.

It will further be appreciated that access to rides may also depend on a child's age in conjunction with the height and/or weight of the child. In this case, the controller will perform the necessary operation to determine access. Also, access to some rides may depend on whether the child is accompanied by a parent. Thus, according to another aspect of the invention, a data carrier for the child's parent is issued and linked in some way (e.g. via a database entry) to the data carrier of the child. The controller then will determine whether the parent's data carrier has been presented before admitting the child.

Figure 4:
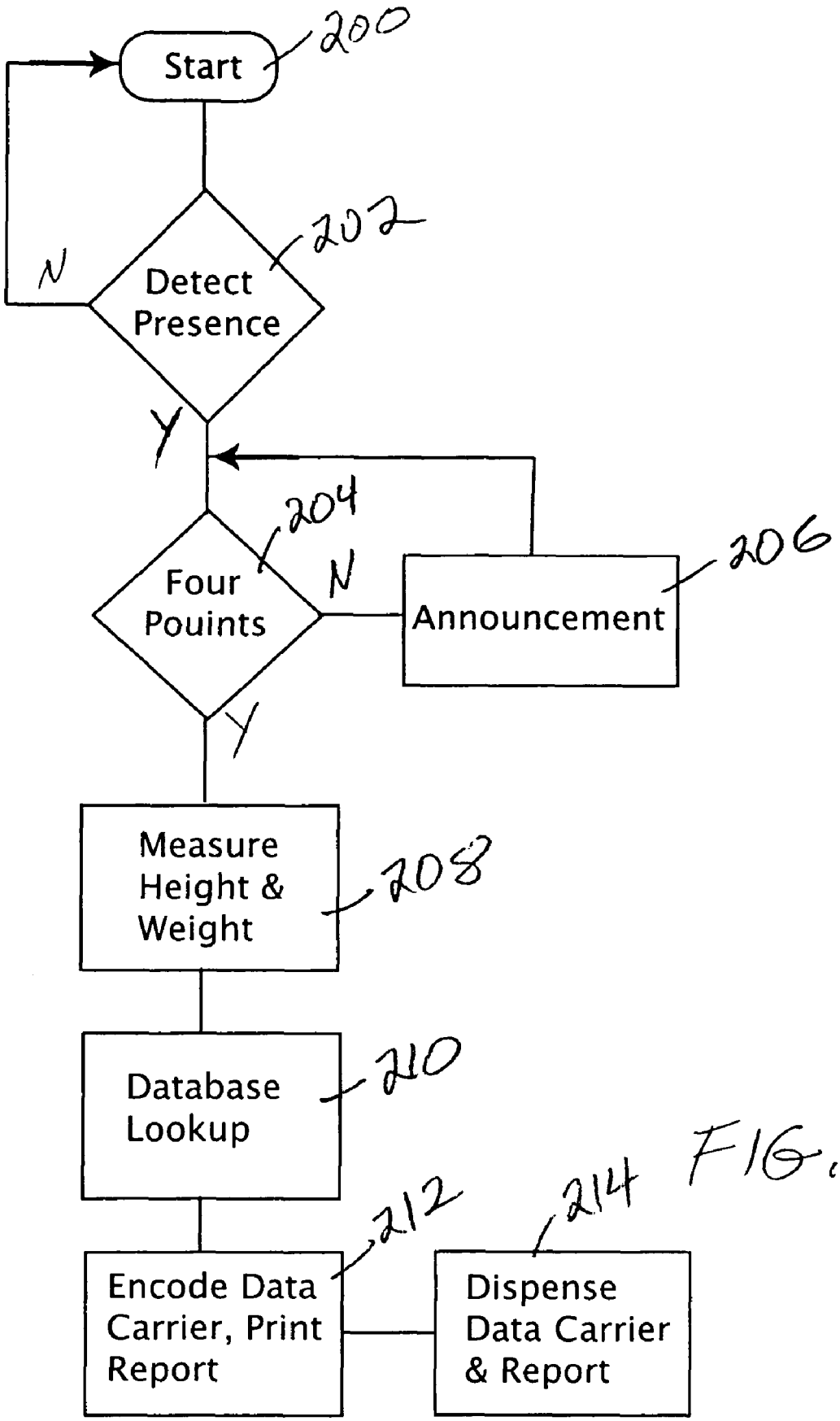
FIG. 4 is a simplified flow chart illustrating a measurement and data carrier encoding method according to the invention.

FIG. 4 illustrates a method of measuring the child and encoding the data carrier according to the invention. Starting at 200, the apparatus (10 in FIG. 1) waits until presence of a child is detected at 202. The child's presence can be detected by sensing weight on the weighing platform (16 in FIG. 1) or by detecting a break in one of the light beams (B in FIG. 1) if the apparatus is arranged to leave the LEDs (12 in FIG. 1) on rather than turn them on only when weight is sensed. At 204 the four foot sensors (16*a*-16*d* in FIG. 1) are examined. If it is determined at 204 that fewer than all four sensors detect pressure, an announcement is made at 206. The announcement may be audible, visual, or both and presents the child with instructions to stand with heels and toes touching the appropriate spots on the weighing platform. In order to assist the child, concentric outlines of different size feet can be painted onto the weighing platform. For an entertaining aesthetic effect, outlines of feet in flashing LEDs can be provided on the weighing platform.

Once it is determined at 204 that the child is standing in the correct place, the child's height, weight and, optionally, age are measured at 208. According to the illustrated embodiment, a database lookup is performed at 210 to determine which rides are appropriate for a child of this height/weight. At 212, a list of rides is printed and a data carrier is encoded. The data carrier and printout are then dispensed at 214. As discussed above, the database lookup and the printout are not essential to the invention. The method of measuring and encoding could directly encode the child's height/weight onto the data carrier for comparison later at admission control points.

Figure 5:
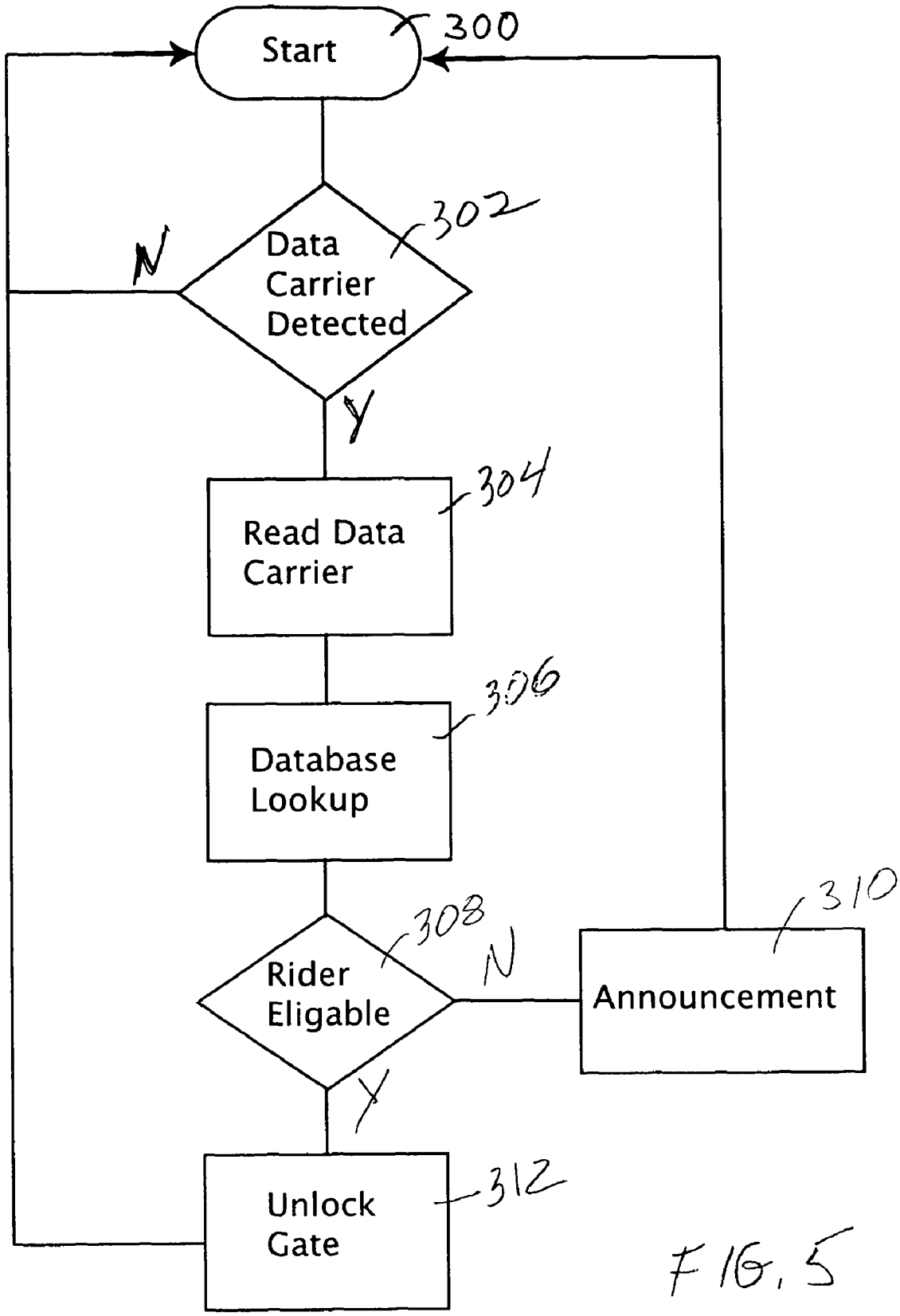
FIG. 5 is a simplified flow chart illustrating an admission control method according to the invention.

FIG. 5 illustrates a method of controlling admission to rides using the data carrier which, as discussed above, may be attached to the child's wrist. Starting at 300, the device (100 in FIG. 3) waits until a data carrier is detected. Detection may be accomplished when the child holds the data carrier next to a scanner. In the case of and RFID data carrier, detection can be accomplished by an RF detector when the child is adjacent the turnstile (102 in FIG. 3). After the data carrier is detected at 302, its contents are read at 304. According to the illustrated embodiment, a database lookup is then performed. This lookup could be a simple comparison of the height/weight data read at 304 to a minimum height/weight requirement stored in the data reader and controller (104 in FIG. 3). However, if the data carrier were encoded with a list of rides, then that list would constitute the database that is looked up at 306 to determine whether or not the present ride is on the list encoded into the data carrier. In either case, after the lookup or comparison, it is determined at 308 whether the child is eligible to be admitted to this ride. If the child is to be denied admission, an announcement is made at 310 and the process returns to 300. The announcement may be audible, visual, or both and will advise the child that admission to this ride is denied because of height/weight requirements. Optionally, the announcement may include a suggestion of one or more nearby rides for which the child is qualified. This information would be obtained from the database lookup at 306. If, on the other hand, the child is to be allowed admission, the turnstile is unlocked at 312. As shown in FIG. 3, the turnstile 102 is preferably designed to minimize the likelihood that two children could pass through at the same time.

There have been described and illustrated herein several embodiments of a method and apparatus for controlling the admission to amusement park rides. While particular embodiments of the invention have been described, it is not intended that the invention be limited thereto, as it is intended that the invention be as broad in scope as the art will allow and that the specification be read likewise. Thus, while the methods and apparatus have been described for restricting admission to amusement park rides based on height/weight, the methods and apparatus can be used in conjunction with other methods and apparatus. For example, the data carrier and admission control points could also be used for billing. The data carrier can be related to a credit or debit account and that account can be credited/debited every time the child gets on a ride. The data carrier can be encoded with demographic data and used to poll the popularity of different rides among different demographic groups. The data carrier can be encoded with information identifying the child and can be used to locate the child. In addition, while particular types of height and weight measuring apparatus have been disclosed, it will be understood that other apparatus can be used. For example, and not by way of limitation, height could be determined by image analysis of a video image of the child or an electromechanical device could be used. Also, while a turnstile has been disclosed, it will be recognized that other admission control devices could be used. It will therefore be appreciated by those skilled in the art that yet other modifications could be made to the provided invention without deviating from its spirit and scope as claimed.

What is claimed is:

1. A method for controlling admission of a child to an amusement park ride, comprising:

a) measuring with height measurement equipment the height of the child upon determining that the child is standing flat-footed at the height measurement equipment via use of a plurality of foot sensors including a left foot toe sensor, a left foot heel sensor, a right foot toe sensor, and a right foot heel sensor;

b) encoding a data carrier with information relating to the height of the child;

c) at a point of access to the ride, reading the data carrier; and d) determining whether the child will be admitted to the ride based on the reading of the data carrier.

2. The method according to claim 1, further comprising:

e) printing a report listing the rides in the amusement park which the child will and/or will not be admitted to based on the child's height.

3. The method according to claim 1, further comprising:

e) before encoding the data carrier, measuring the weight of the child using said plurality of foot sensors; and f) encoding the data carrier with information relating to the weight of the child.

4. The method according to claim 1, wherein:

the steps of measuring and encoding are performed once, and the steps of reading and determining whether the child will be admitted are performed at each ride.

5. The method according to claim 1, further comprising:

e) after said step of determining whether the child will be admitted, operating an admission control device to allow admission or deny admission to the ride.

6. The method according to claim 1, wherein:

each of the steps is performed by one or more machines.

7. The method according to claim 5, wherein:

each of the steps is performed by one or more machines.

8. Apparatus for controlling admission of a person to an amusement park ride, comprising:

a) apparatus including a plurality of sensors which determines whether the person is standing flat-footed, said plurality of sensors including a left foot toe sensor, a left foot heel sensor, a right foot toe sensor, and a right foot heel sensor;

b) measuring apparatus coupled to said apparatus including a plurality of sensors, for measuring the height of the person when said apparatus including a plurality of sensors determines that the person is standing flat-footed;

c) a data carrier;

d) encoding apparatus coupled to said measuring apparatus for encoding said data carrier with information relating to the height of the person;

e) reading apparatus for reading the data carrier; and f) determining apparatus coupled to said reading apparatus for determining whether the person will be admitted to the ride based on the reading of the data carrier.

9. The apparatus according to claim 8, further comprising:

admission control apparatus coupled to said determining apparatus and responsive to said determining apparatus to allow admission or deny admission to the ride.

10. The apparatus according to claim 9, wherein:

said admission control apparatus includes a turnstile.

11. The apparatus according to claim 8, wherein:

said measuring apparatus includes a light emitter and a light detector.

12. The apparatus according to claim 8, wherein:

said data carrier is selected from the group consisting of a swipe card, a bar coded card, a bar coded bracelet, and an RFID device.

13. The apparatus according to claim 8, wherein:

said plurality of sensors comprise weight sensing apparatus, and wherein said encoding apparatus further encodes said data carrier with information relating to the weight of the person as determined by said weight sensing apparatus.

* * * * *